United States Patent [19]

Kikkawa et al.

[11] 3,953,312

[45] Apr. 27, 1976

[54] APPARATUS FOR PEELING ELECTRODEPOSITED METAL OFF CATHODE BASE PLATE

[75] Inventors: Takahiro Kikkawa; Toshinori Hirata, both of Oaza-Higashi, Japan

[73] Assignee: Mitsui Mining & Smelting Co., Ltd., Tokyo, Japan

[22] Filed: July 10, 1974

[21] Appl. No.: 487,204

Related U.S. Application Data

[63] Continuation of Ser. No. 302,843, Nov. 1, 1972, abandoned.

[30] Foreign Application Priority Data

Apr. 19, 1972 Japan ..... 47-38728

[52] U.S. Cl. ..... 204/198; 204/12; 204/281

[51] Int. Cl.[2] ..... C25D 17/00; C25D 1/00; C25D 1/04

[58] Field of Search ..... 204/12, 281, 198, 225, 204/194; 156/580, 584

[56] References Cited

UNITED STATES PATENTS

| | | | |
|---|---|---|---|
| 3,124,521 | 3/1964 | Sviadoshch et al. | 204/281 |
| 3,501,385 | 3/1970 | Jasberg | 204/12 |
| 3,625,806 | 12/1971 | Wennberg | 156/584 |
| 3,689,396 | 9/1972 | Casagrande | 156/584 |
| 3,724,471 | 4/1973 | Sitges | 204/12 |
| 3,840,032 | 10/1974 | Sitges | 204/281 |

*Primary Examiner*—T. M. Tufariello
*Attorney, Agent, or Firm*—Woodhams, Blanchard and Flynn

[57] ABSTRACT

A method of peeling the electrodeposited metal plate off the cathode base plate by inserting a wedge downward in the fine void formed previously between said cathode base plate and electrodeposited metal plate by hammering the surface of the upper edge of said electrodeposited metal plate, wherein a low pressure fluid is jetted from the vicinity of the tip of the wedge toward said fine void prior to insertion of said wedge therein.

3 Claims, 7 Drawing Figures

23
22
P''
22
23
26
17
18
21
13
16
19
20
15
12
14
P'
P''
P'
P''

APPARATUS FOR PEELING ELECTRODEPOSITED METAL OFF CATHODE BASE PLATE

This is a continuation of application Ser. No. 302,843, filed Nov. 1, 1972, now abandoned.

BACKGROUND OF THE INVENTION a. Field of the Invention

The present invention relates to a method of automatically peeling the electrodeposited metal plate (hereinafter called 'metal plate') off the cathode base plate (hereinafter called 'base plate'), which is applicable to the metal recovering process in electrolytic refining of metal in which a cathode plate has a metal plate electrolytically deposited on its surface.

b. Description of the Prior Art

As the most prevalent means of peeling the metal plate off the base plate in the prior art, there are the method comprising the steps of previously forming a fine void between the base plate and the metal plate by applying a mechanical impact to the surface of the upper edge of the metal plate, then stripping a part of the metal plate off the base plate by means of a vacuum pad and subsequently separating the two plates from each other by inserting a wedge in between their boundary surfaces, and the method comprising the step of jetting a high pressure fluid toward the contact surfaces of the two plates to thereby peel the metal plate off the base plate.

However, the former method is defective in that, despite the requirement for sufficient smoothness of the surface of the metal plate enough to make the vacuum pad work, due to the differences of such conditions as the time spent in electrolysis, the state of electrolyte, etc., the surface of the metal plate cannot always be smooth: rather it can present a remarkably rough, uneven condition, and sometimes pinholes occur on the metal plate, thereby rendering the vacuum pad practically useless.

As for the latter method, it is also defective in that, depending on such conditions as pressure, etc., a vacuum may be produced between the metal plate and the base plate to thereby give rise to the phenomenon that the metal plate is pulled back toward the surface of the base plate, rendering it difficult to effect the peeling-off. Moreover, it has such defects that, because of the requirement for a great deal of motive power in producing the high pressure fluid, it entails a high cost, is always attended with danger, and requires a large equipment to dispose of the used fluid.

SUMMARY OF THE INVENTION

The principal object of the present invention is to provide an improved method of peeling the metal plate off the base plate, which avoids the foregoing defects of the conventional methods of peeling off.

Another object of the present invention is to provide a method of peeling the metal plate off the base plate, which comprises the steps of first giving a mechanical impact to the surface of the upper edge of the metal plate to form a fine void between the base plate and metal plate, jetting a low pressure fluid from above into said fine void to float the metal plate off the base plate by virtue of the pressure of jet and then inserting a wedge in the resulting opening between the metal plate and base plate to thereby peel the metal plate off the base plate without resorting to any vacuum pad, and accordingly renders it possible to perform the peeling-off smoothly without regard to the smoothness of the surface of said metal plate.

Still another object of the present invention is to provide a method of peeling the metal plate off the base plate efficiently by virtue of the application of a gas having a low pressure, preferably in the range of 1 to 3 $Kg/cm^2$, as the pressure fluid for the purpose of floating the metal plate off the base plate, which renders it possible to float the metal plate off the base plate rapidly and with certainty without producing a vacuum between the base plate and metal plate.

According to the present method, the cathode plate is mounted on an intermittently movable chain conveyer, and by virtue of the intermittent movement of said chain conveyer, the cathode plate is made to move for a fixed time after being suspended for a fixed time. And through repetition of this operation, the cathode is made to move transversely.

During the first suspension of the cathode, intermittent impacts are given to the opposite surfaces of the two metal plates attached to two sides of the base plate by means of air hammers disposed face to face across the upper edge portions of said metal plates to thereby form fine voids between the base plate and the metal plate, and subsequently the motion of said air hammers is stopped and the cathode plate is moved.

During the next suspension of the cathode following the foregoing movement, the upper edge portion of the cathode base plate is clamped by a clamping mechanism, the fluid-jetting nozzle is drawn near above the fine void between the cathode base plate and the electrodeposited metal plate, a low-pressure fluid is jetted toward said fine void through said nozzle, and the metal plate is floated off the base plate by virtue of the jet pressure of said low-pressure fluid.

After the lapse of a prescribed time subsequent to the jetting of said low-pressure fluid, the wedge disposed above the cathode plate with its tip down descends, the wedge is thrust into the gap between the floated metal plate and the base plate, the metal plate is gradually peeled off the base plate as the wedge continues to descend, and the peeling work is completed when the descent of the wedge finishes.

BRIEF DESCRIPTION OF THE DRAWING

In the appended drawings.

DETAILED DESCRIPTION OF THE INVENTION

Figure 1:
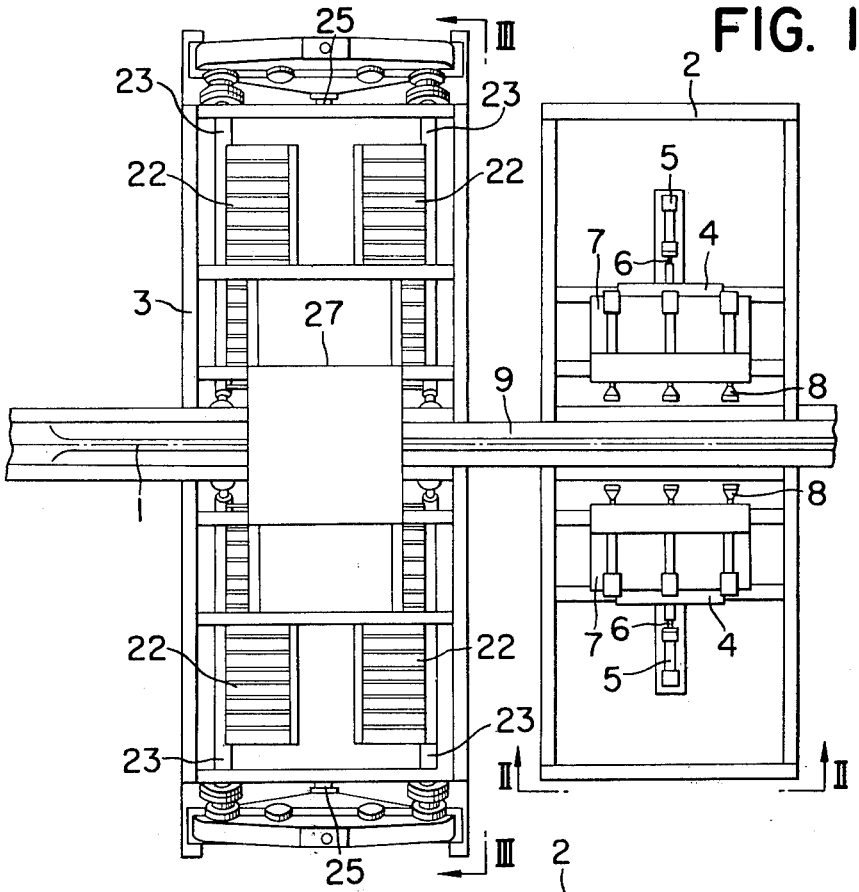
FIG. 1 is a top plan view of an apparatus which may be utilized in practicing the method of the present invention.
Figure 2:
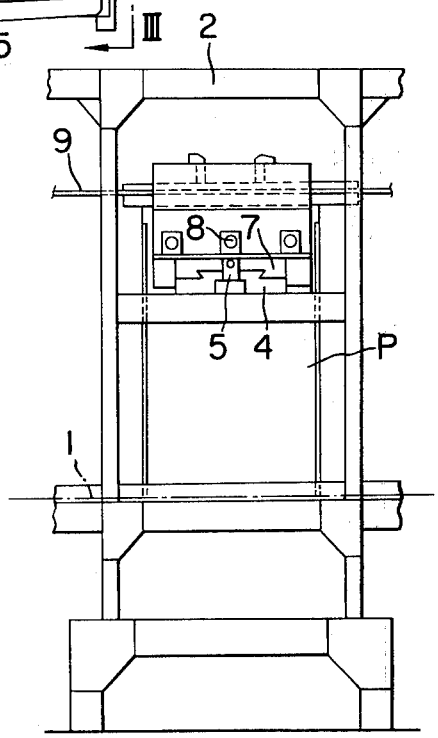
FIG. 2 is a view taken along the line II — II in FIG. 1.

Referring to FIGS. 1 and 2, the reference numeral 1 denotes the chain conveyer to be operated intermittently by a motor (not shown). The cathode plate P, whose lower end is on said chain conveyer 1, is made to move from right to left in FIGS. 1 and 2 at regular intervals of time. On this occasion, the top of the cathode plate P is led by the guide frame 9 which connects the frame 2 with the frame 3.

The frame 2 is provided with the air hammer mechanism, said air hammer mechanism is supported by the slide ways 4 horizontally disposed so as to face opposite sides of the cathode plate P. The cylinders 5 are installed on these slide ways 4. The tip of the rod 6 of each said cylinder 5 is connected with a slide member 7 which slides along the slide way 4, and several air hammers 8 are mounted on said slide member 7. When the cathode plate P carried by the chain conveyer 1 arrives at the place where said air hammer mechanism is located, it stops upon instruction of the sensing mechanism (not shown), the cylinders 5 operate to bring the air hammers 8 near both sides of the upper part of the cathode plate P, then the air hammers 8 work to give intermittent impacts to the surface of the metal plates P'' attached to both sides of the base plate P' of the cathode plate P to form fine voids between the base plate P' and the metal plate P'' by virtue of said impacts. The air hammers 8 stop working after thus giving impacts for a fixed period of time and move backward, and then the chain conveyer 1 works again to move the cathode plate P transversely.

When the thus conveyed cathode plate P arrives at the place of peeling, that is, the place where the cathode plate P is positioned between the opposing wedges 13 installed on the frame 3 as illustrated in FIGS. 3 to 6, it stops upon instruction of the sensing mechanism (not shown). The cylinders 14 work to advance the clamp bodies 15 simultaneously and the arms 16 installed on the top of said clamp bodies 15 simultaneously work to advance the rods 26 fitted in the spring 17 respectively. The cylinders 18 are attached at their lower ends to the tips of the rods 26 and are pivoted on the supporting frame 27 at their upper ends. Thus, movement of rods 26 moves the lower ends of the cylinders 18 toward the cathode plate P. The clamp plates 19 equipped on the tip of the clamp body 15 come in contact with the upper edge of the cathode plate P to hold it firmly therebetween. The nozzles 20, each nozzle being equipped along the side of a clamp plate 19 of said clamp body, face at an angle in the range of 45° to 90° toward the cathode plate P near the upper edge of the metal plates P'' deposited on the base plate P'. The tips of the wedges 13 also comes in contact with or very close to the base plate P', to be located immediately above the upper edge of the metal plate P''. At this time, the apparatus is in the condition illustrated in FIG. 6.

Once the cathode plate P is firmly held by the clamp bodies 15, a gas valve (not shown) senses it and opens to jet a low-pressure gas having a pressure of less than 7 Kg/cm$^2$, preferably a pressure in the range of 1 to 3 Kg/cm$^2$, through the nozzles 20 toward the joint of the base plate P' and the metal plate P'', and, by virtue of the jet pressure, the upper edge of the metal plate P'' is floated off the base plate P'. After the start of gas jetting, by the subsequent working of the cylinders 18, the rods 21 of said cylinders are pushed out to make the wedges descend along both sides of the base plate P' and thrust the tips of said wedges into the void between the base plate P' and the metal plates P'' floated off the base plate P', and, as the wedges continue to descend, the metal plates P'' are gradually peeled off the base plate P'.

The metal plates P'' peeled off both sides of the base plate P' fall sideways and drop onto the roller conveyers 22. Subsequently, the cylinders 25 work to turn the shafts 23, whereby the roller conveyers 22 mounted on said shafts 23 move to the position shown in dotted lines in FIG. 7 and drop the peeled metal plate P'' put thereon onto the conveyers 24 installed thereunder. After that, the roller conveyers 22 return to their original positions, and the metal plate P'' is transferred by means of the conveyers 24.

After the wedges 13 descend to the bottom of the base plate P' and finish peeling the metal plates P'' off the base plate P', the cylinders 18 rapidly move the wedges 13 upward, so as to return them back to their original positions. At the same time, the clamp cylinders 14 perform a backward stroke, whereby the clamp bodies 15 retreat, the base plate P' is released from the clamp plates 19, and also the wedges 13 are pulled off the surfaces of the base plate P' by means of the arms 16 and the rods 26.

Figure 3:
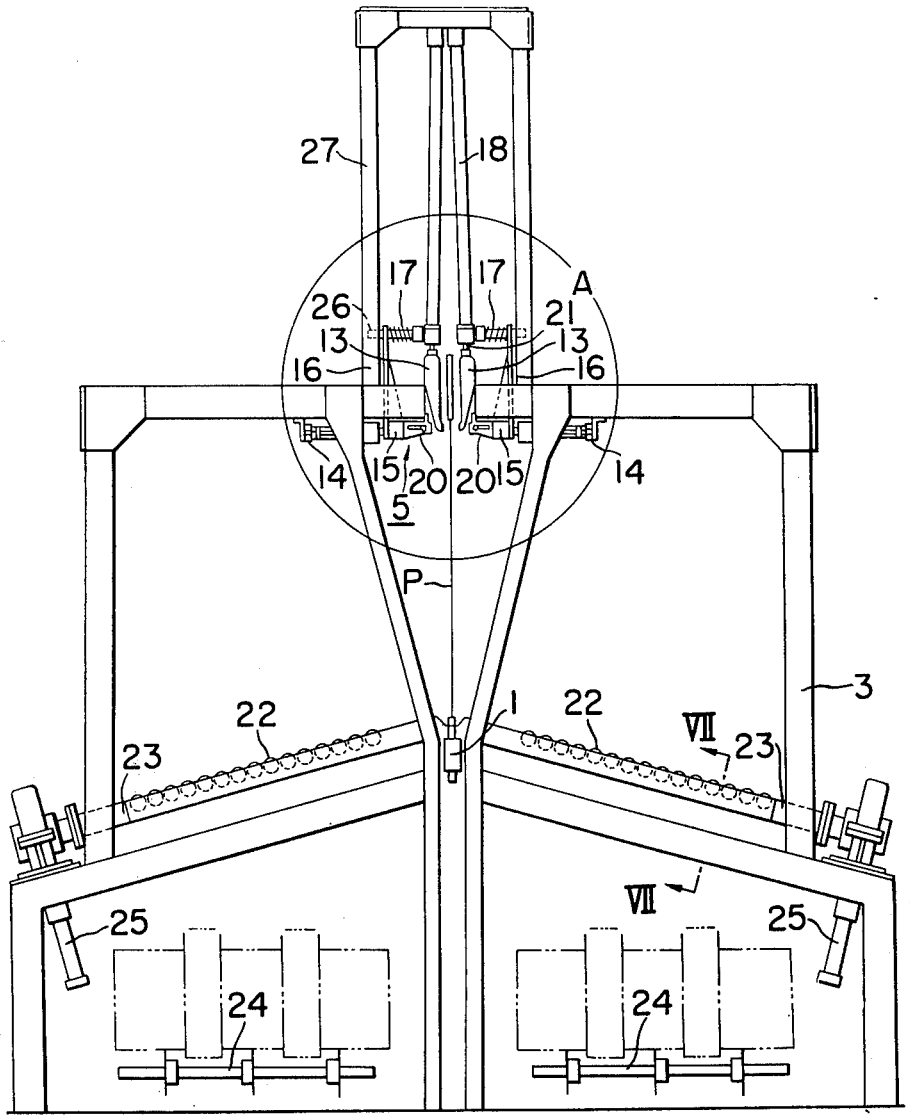
FIG. 3 is a view taken along the line III — III in FIG. 1.
Figure 4:
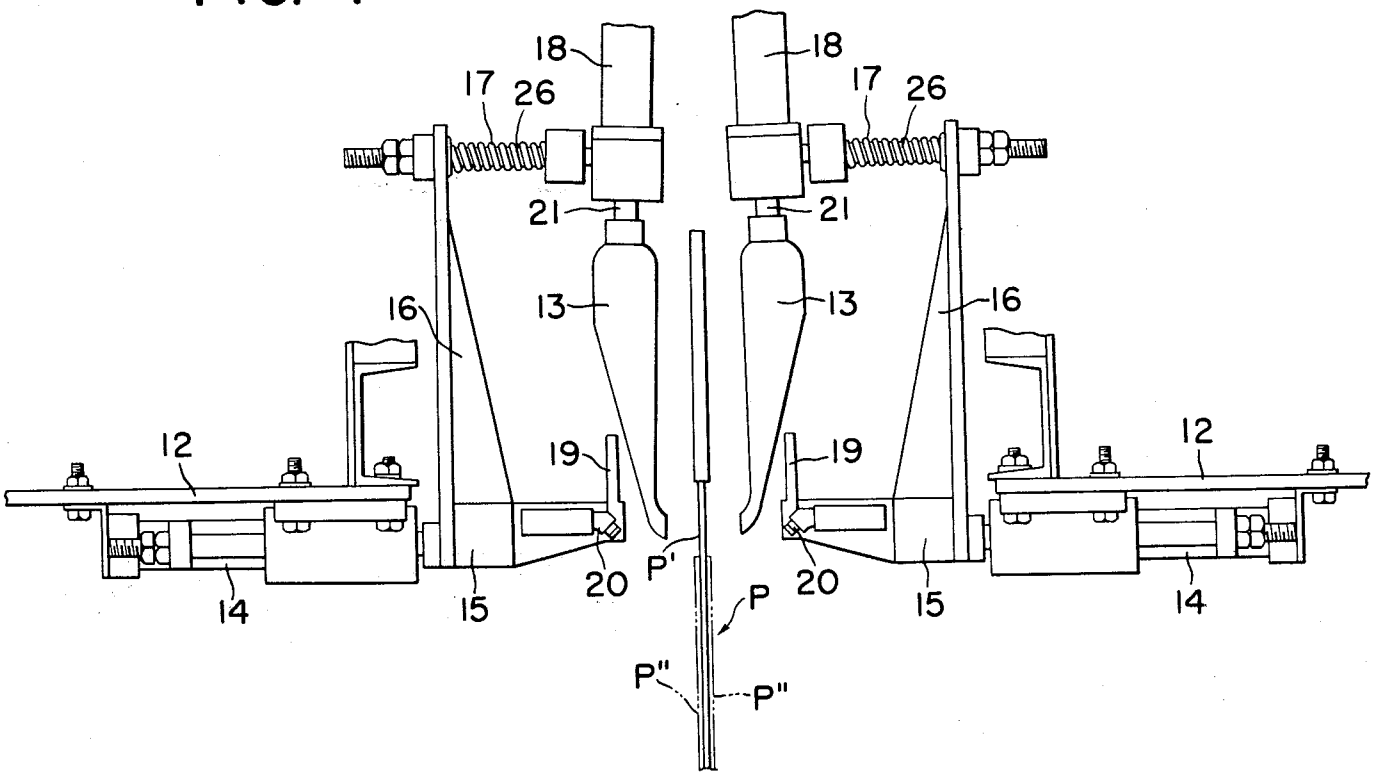
FIG. 4 is the front view, on an enlarged scale, of the portion A encircled with a thin line in FIG. 3.
Figure 5:
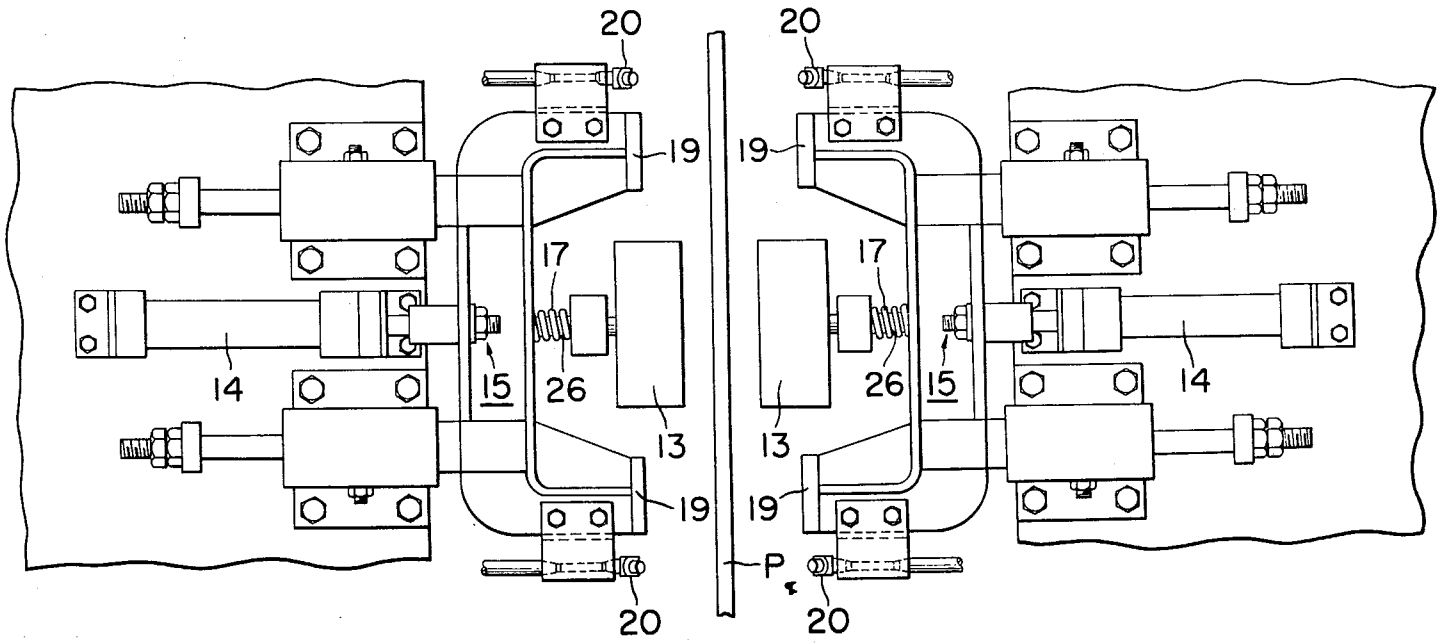
FIG. 5 is a plan view of the portion A viewed from its bottom.
Figures 6, 7:
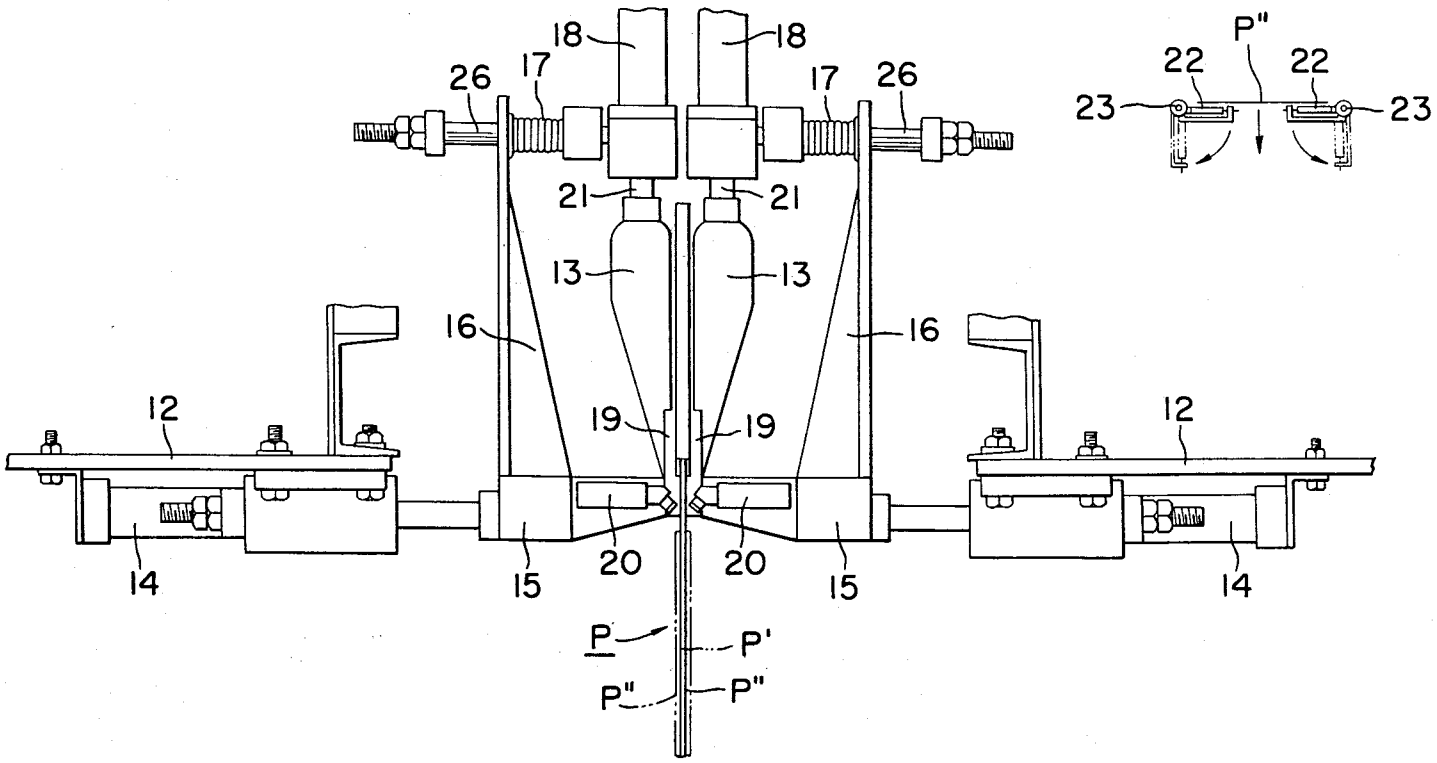
FIG. 6 is a view similar to FIG. 4, showing a different operating of the parts.
FIG. 7 is a view taken along the line VII — VII in FIG. 3.

In this way, one cycle of the peeling work is completed and the state shown in FIG. 3 is restored. At this, the base plate P' is moved by means of the working chain conveyer 1 and, at the same time, another cathode plate P is sent to the place where the peeling-off is to be performed. Thus, the same peeling work as described above starts again, and such operation is repeated thereafter.

Tests conducted by applying the jetting process according to the present invention to the metal plate electrodeposited onto the base plate over a 16 to 48 hours' period in zinc electrolytic refining resulted in the following findings.

To begin with, as for the jet pressure of the compressed gas, it was possible to float a portion of the upper edge of the metal plate off the base plate sufficiently for permitting more effective insertion of the wedge mechanism between said two plates by application of a very low pressure, preferably a pressure in the range of 1 to 3 Kg/cm$^2$. In the case of application of a high pressure (at least 7 Kg/cm$^2$), there occurred a turbulent flow of air current in the vicinity of the upper edge of the metal plate after collision between the jetting gas and the base plate, bringing about partial inequality of pressure, and in the majority of the tests, there was observed the phenomenon that the metal plate once floated off the base plate was pulled back again to the surface of the base plate.

Next, as for the applicable jet angle against the base plate, a series of tests were conducted by disposing the nozzle at various angles of ±45° against the perpendicular surface of the cathode plate, and, as a result, the difference in jet angle to the foregoing extent proved no obstacle from the viewpoint of practical use though there was a little difference in efficiency.

In short, the foregoing tests have verified that the effect of floating a part of the upper edge of the metal plate off the base plate to such an extent as to permit insertion of the wedge therebetween is dependent on the jet pressure itself rather than on the type and disposition of the nozzle.

Although particular preferred embodiments of the invention have been disclosed hereinabove for the purpose of illustration, it will be understood that variations or modifications thereof which lie within the scope of the invention as defined by the appended claims are fully contemplated.

What is claimed is:

1. An apparatus for peeling off electrodeposited metal plates from cathode base plates, comprising:

conveyor means for moving upright workpieces comprised of cathode base plates having electrodeposited metal plates adhering thereon through two work stations in series;

impact means located at the first work station for applying repeated impacts to the electrodeposited metal plates adjacent the upper edges thereof to form voids between the cathode base plate and the electrodeposited metal plates;

stripping means at the second work station for peeling off the electrodeposited metal plates from the cathode base plate, said stripping means comprising a stationary framework defining an upright passage through which the upright workpieces move, said framework having an overhead portion located above said passage, a pair of fluid pressure motors comprising a pair of cylinders supported on said overhead framework and pivotally mounted thereon so that their lower ends are laterally movable toward and away from said passage, said cylinders extending downwardly from said framework so that their lower ends are located close to the upper end of said passage on opposite sides thereof, pistons projecting from the lower ends of said cylinders and having wedges thereon positioned for engagement with the opposite surfaces of the cathode base plate and being movable downwardly along the cathode base plate in response to supply of fluid pressure to said cylinders in order to strip off the electrodeposited metal plates, said cylinders each having a guide rod projecting laterally therefrom in a direction away from said passage, a pair of clamp bodies respectively associated with said cylinders, each clamp body having an upwardly extending arm slidably mounted on said guide rod of its associated cylinder and a coil spring encircling said guide rod and bearing at one end against said arm and urging said arm and said clamp body outwardly on said guide rod, said clamp bodies being substantially U-shaped and having clamp plates on the free ends of the legs thereof disposed for engaging the upper portions of the cathode base plate above the upper edges of the electrodeposited metal plates for clamping said workpiece in a fixed upright position, said wedges respectively being disposed between said legs of said clamp bodies, each clamp body having mounted thereon at positions outside of and adjacent the clamp plates thereof a pair of nozzles arranged to direct low pressure fluid against the cathode base plate at an angle of from +45° to −45° relative to an imaginary line perpendicular to the vertical plane of the cathode base plate and against the upper edges of the electrodeposited metal plates to separate the upper edges of the electrodeposited metal plates from the cathode base plate;

motor means for moving said clamp bodies laterally of said passage into and out of clamping engagement with the upper portion of the cathode base plate and thereby moving said wedges likewise into resilient contact with said upper portion of the cathode base plate under the compression forces of said springs; and means for receiving the electrodeposited metal plates peeled off by said wedges.

2. An apparatus according to claim 1, in which said motor means comprises a second pair of fluid pressure motors respectively connected to said clamp bodies for moving said clamp bodies, said nozzles and the lower ends of said cylinders of said first-named pair of fluid pressure motors toward and away from the cathode base plate.

3. An apparatus according to claim 2, in which said means for receiving the peeled off electrodeposited metal plates comprises generally planar elongated roller conveyors extending sidewardly in a direction away from the position occupied by the cathode base plate during the peeling off step, means supporting said roller conveyors for pivotal movement about an axis parallel to the lengthwise extent thereof and means for pivoting said roller conveyors between a position in which they are inclined outwardly and downwardly at a small angle relative to the horizontal so that the peeled off electrodeposited plates fall onto said roller conveyors and a position in which they extend substantially vertically downwardly, and further conveyors disposed below said roller conveyors for receiving the electrodeposited metal plates from said roller conveyors when said roller conveyors are moved to said substantially vertical position.

* * * * *